US006674871B1

(12) United States Patent
Chan

(10) Patent No.: US 6,674,871 B1
(45) Date of Patent: Jan. 6, 2004

(54) POSITIONING DEVICE FOR DIAPHRAGM FOR SPEAKERS

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 10/314,112

(22) Filed: Dec. 7, 2002

(51) Int. Cl.[7] ..... H04R 25/00
(52) U.S. Cl. ..... 381/403; 381/424
(58) Field of Search ..... 381/404, 403, 381/423, 405, 424, 430, 371, 150, 396; 181/164, 165, 171, 173

(56) References Cited

U.S. PATENT DOCUMENTS 3,364,315 A * 1/1968 Gorike ..... 381/405
5,790,682 A * 8/1998 Hachiya et al.

* cited by examiner

*Primary Examiner*—Sinh Tran

(57) ABSTRACT

A positioning device for a diaphragm of speakers includes an inner ring and an outer ring with a plurality of connection plates connected between the inner ring and the outer ring. The positioning device is attached to a side of the diaphragm and has a wave-shaped cross section which is complimentary to a shape of the diaphragm. The diaphragm is retained by the positioning device and will not shifts during operation.

4 Claims, 6 Drawing Sheets

POSITIONING DEVICE FOR DIAPHRAGM FOR SPEAKERS

FIELD OF THE INVENTION

The present invention relates to a positioning device that includes two positioning plates connected to two sides of the diaphragm and at least one of the two positioning plates has the same waved-shaped cross section as the diaphragm.

BACKGROUND OF THE INVENTION

A conventional speaker is widely used among many types of speaker and used for a variety of purposes such as a radio and hi-fi system. A basic structure of a conventional cone speaker includes a damper which supports the central part of the speaker and the peripheral part is supported by a frame through an edge. The edge is functioned as a spring to return a back-and-forth movement of the diaphragm. A voice coil is applied with a current to oscillate the diaphragm, thereby generating a sound. It is important to let the diaphragm vibrate back-and-forth in stable condition thereby generating a stable sound having a desired quality. Although the designers develop different types of material to provide more flexibility to generate a wide range of sound, the diaphragm could shift during operation and this affects the quality of sound.

The present invention intends to provide a positioning device that holds the diaphragm and prevents the diaphragm from being shifted during operation.

SUMMARY OF THE INVENTION

In accordance with one aspect of the present invention, there is provided a positioning device for a diaphragm of speakers and the device comprises an inner ring and an outer ring. A plurality of connection plates are connected between the inner ring and the outer ring. The positioning device is attached to a side of the diaphragm and has a wave-shaped cross section which is complimentary to a shape of the diaphragm.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
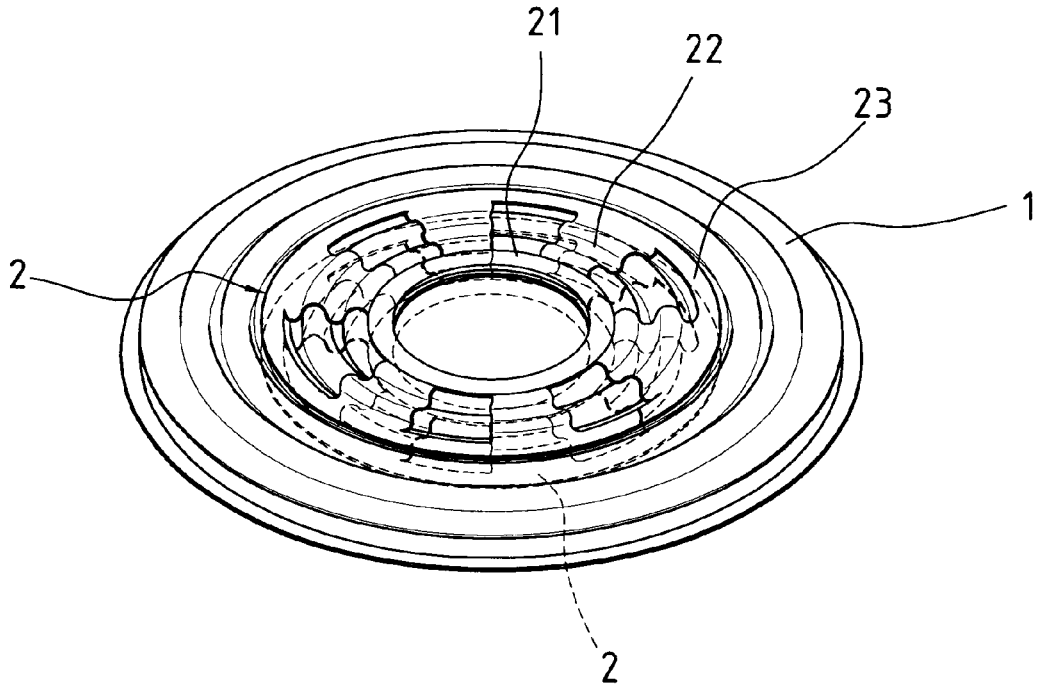
FIG. 1 is a perspective view to show the combination of the positioning device of the present invention and the diaphragm of speakers.
Figure 2:
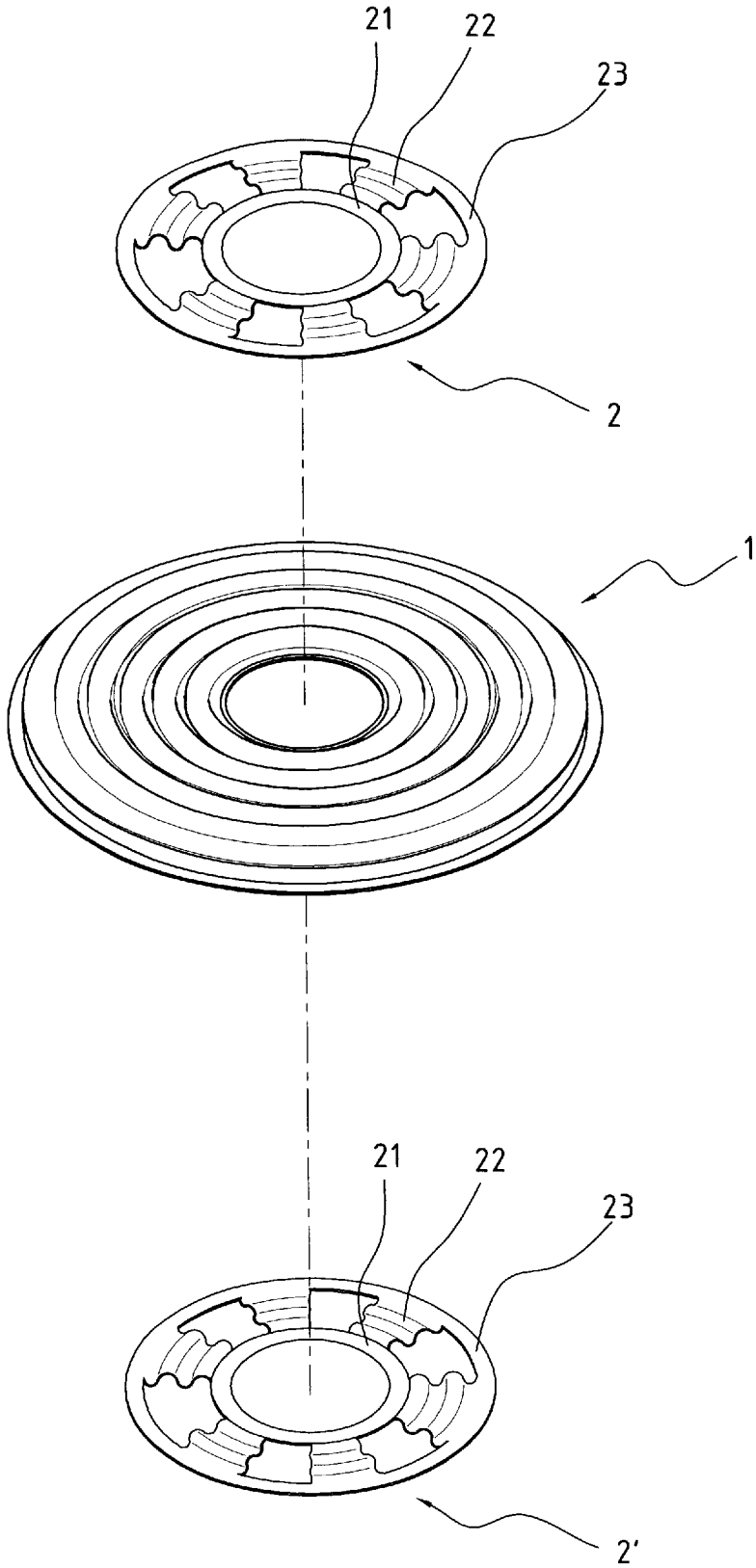
FIG. 2 is an exploded view to show the positioning device of the present invention.
Figure 5:
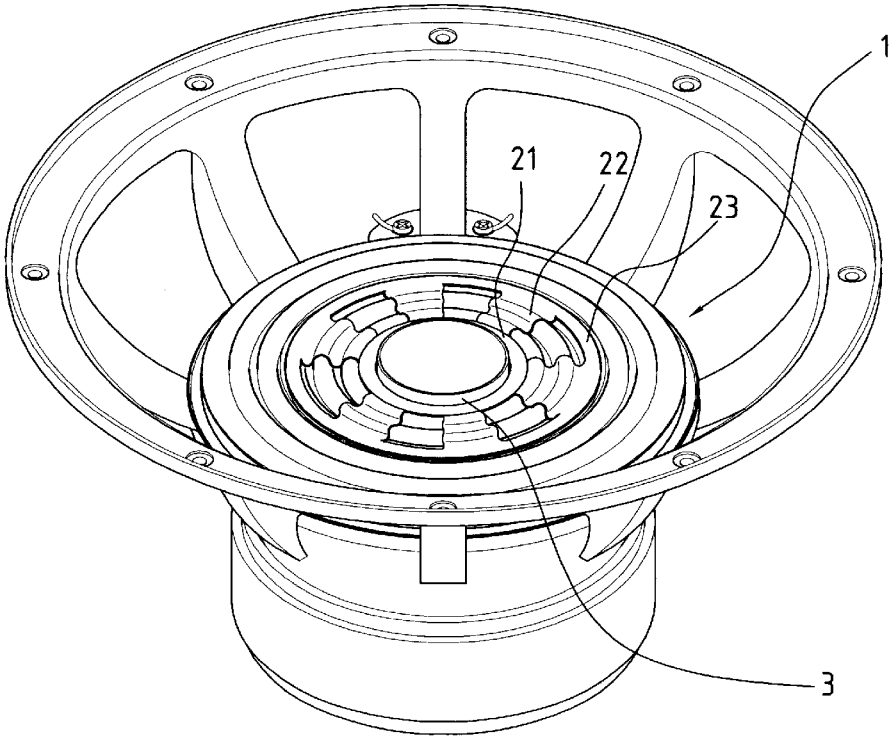
FIG. 5 shows the positioning device of the present invention is used in a speaker.

Referring to FIGS. 1 and 2, the positioning device of the present invention comprises a first part 2 and a second part 2', the first part 2 and the second part 2' are respectively attached to two sides of the diaphragm 1 of a speaker as shown in FIG. 5. A voice coil 3 extends through a central hole of the diaphragm 1 and the two respective central holes of the first part 2 and the second part 2'.

In the embodiment as shown in FIGS. 1 and 2, the first part 2 is identical to the second part 2' and includes an inner ring 21 and an outer ring 23. A plurality of connection plates 22 are connected between the inner ring 21 and the outer ring 23. The first part 2 and the second part 2' each have a wave-shaped cross section which is complimentary to a shape of the diaphragm 1 so that the diaphragm 1 is retained between the first part 2 and the second part 2' and is not moved during operation. The two parts 2, 2' can be glued to the diaphragm 1 or be connected to the diaphragm by way of plastic injection.

Figure 3:
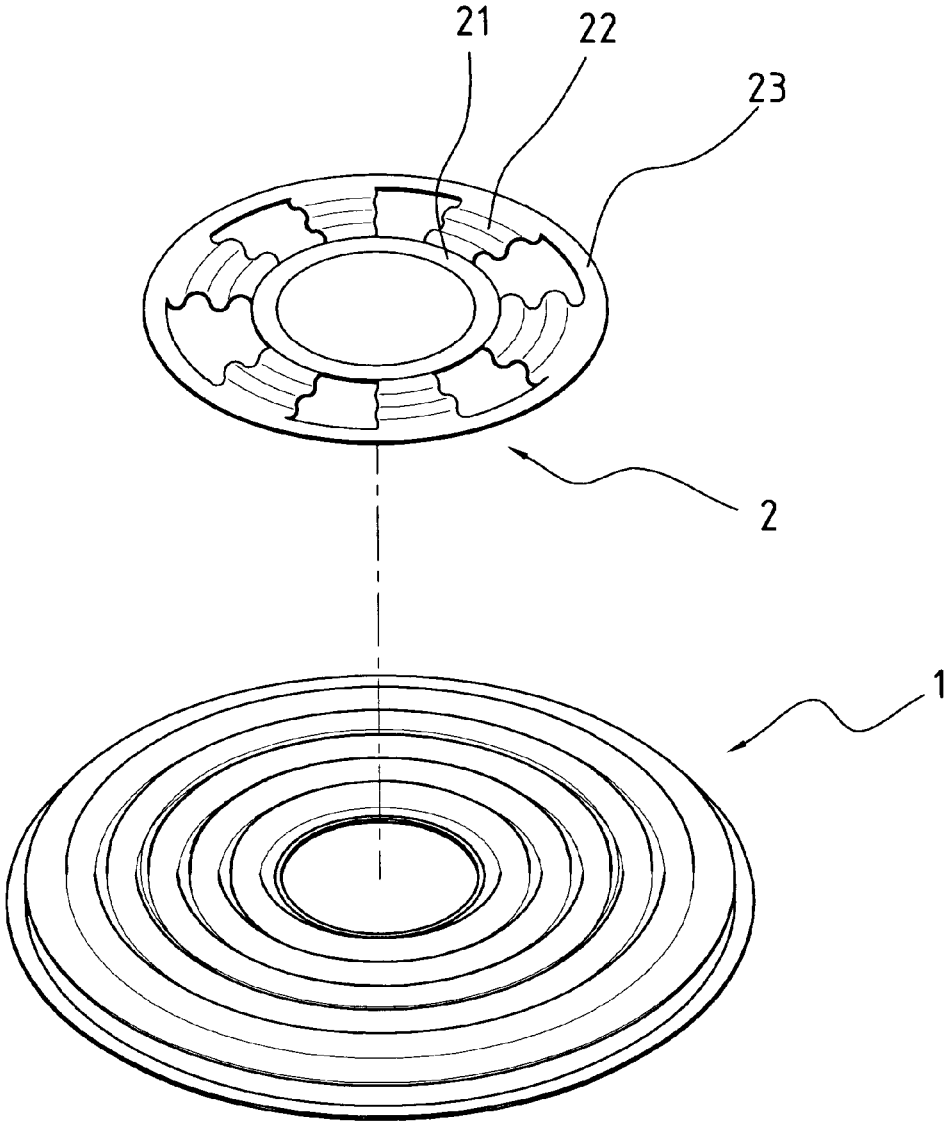
FIG. 3 shows only one side of the diaphragm is connected with the positioning device.
Figure 4:
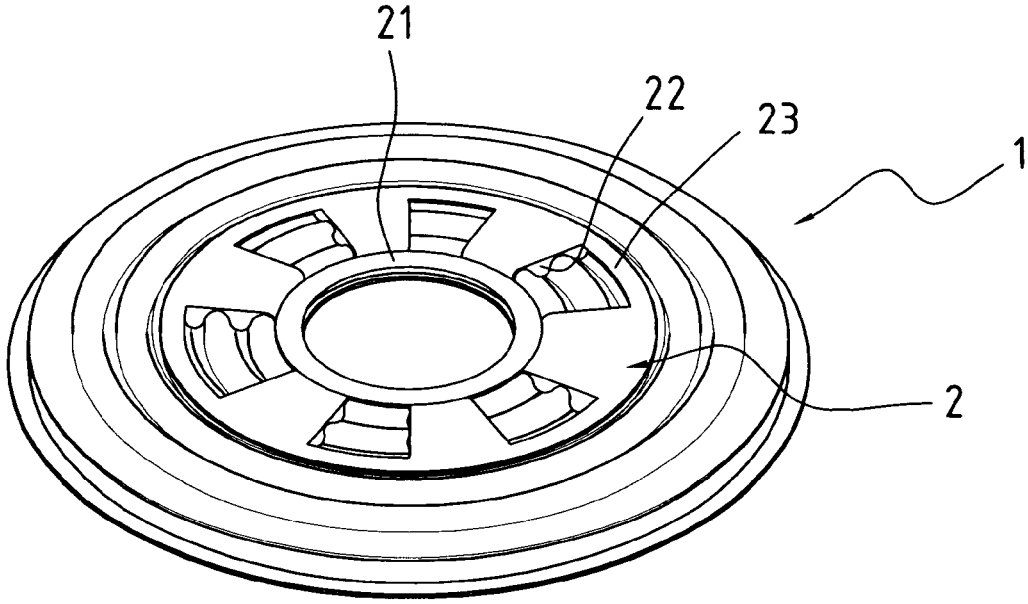
FIG. 4 shows that one of two parts of the positioning device has a flat surface.

FIG. 3 shows that only the first part 2 is used to be connected with the diaphragm 1. FIG. 4 shows that one of the two parts 2, 2' has a flat surface which is not mounted to the wave-shaped diaphragm 1 snugly.

Figure 6:
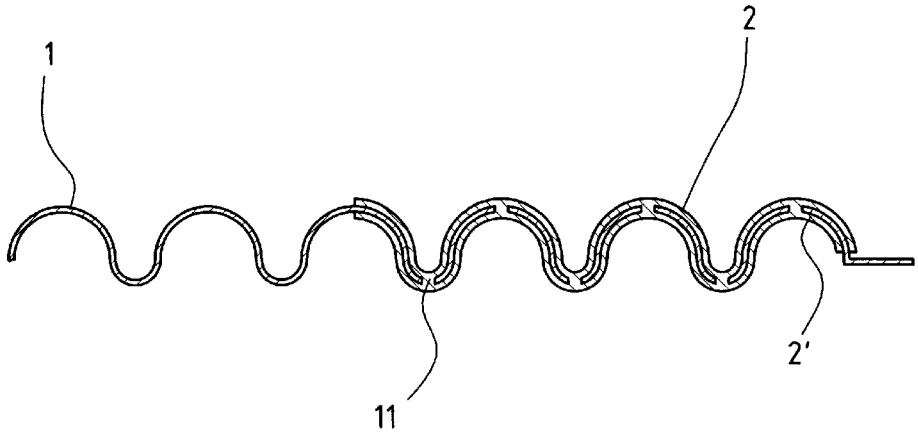
FIG. 6 shows the positioning device of the present invention is made in a one-piece member with the diaphragm.

FIG. 6 shows that the diaphragm 1 has a wave-shaped cross section and a plurality of holes 11 are defined therethrough 1. The positioning device includes a first part 2 which is mounted to a first side of the diaphragm 1 and a second part 2' which is mounted to a second side of the diaphragm 1. A material of the positioning device extends through the holes 11 of the diaphragm 1 to connect the first part 2 and the second part 2'. This can be done by way of plastic injection and the two parts 2 and 2' and the diaphragm 1 is made to be a one-piece member.

While we have shown and described the embodiment in accordance with the present invention, it should be clear to those skilled in the art that further embodiments may be made without departing from the scope of the present invention.

What is claimed is:

1. A positioning device for a diaphragm of speakers, comprising:

a first part including an inner ring and an outer ring, a plurality of connection plates connected between the inner ring and the outer ring, the first part adapted to be attached to a first side of the diaphragm, the first part having a wave-shaped cross section which is adapted to be complimentary to a shape of the diaphragm.

2. The device as claimed in claim 1, further comprising a second part which is adapted to be attached to a second side of the diaphragm, the second part having a wave-shaped cross section which is adapted to be complimentary to a shape of the diaphragm.

3. The device as claimed in claim 1, further comprising a second part which is adapted to be attached to a second side of the diaphragm, the second part having a flat surface.

4. A combination of a positioning device and a diaphragm of speakers, wherein the diaphragm has a wave-shaped cross section and a plurality of holes defined therethrough, and the positioning device includes a first part which is mounted to a first side of the diaphragm and a second part which is mounted to a second side of the diaphragm, a material of the positioning device extends through the holes of the diaphragm to connect the first part and the second part.

* * * * *